US006086957A

United States Patent [19]

Boyle et al.

[11] Patent Number: 6,086,957

[45] Date of Patent: Jul. 11, 2000

[54] METHOD OF PRODUCING SOLUTION-DERIVED METAL OXIDE THIN FILMS

[75] Inventors: Timothy J. Boyle; David Ingersoll, both of Albuquerque, N. Mex.

[73] Assignee: Sandia Corporation, Albuquerque, N. Mex.

[21] Appl. No.: 09/321,911

[22] Filed: May 28, 1999

[51] Int. Cl.[7] ..... B05D 3/02; B05D 1/18; B05D 3/12; B05D 1/38

[52] U.S. Cl. ..... 427/376.2; 427/126.5; 427/240; 427/376.4; 427/379; 427/380; 427/419.2; 427/430.1; 427/435; 427/443.2

[58] Field of Search ..... 427/126.5, 240, 427/380, 376.2, 419.2, 430.1, 443.2, 379, 435, 376.4

[56] References Cited

U.S. PATENT DOCUMENTS

| | | | |
|---|---|---|---|
| 4,129,434 | 12/1978 | Plumat et al. | 65/60 D |
| 4,259,371 | 3/1981 | Postupack et al. | 427/226 |
| 4,960,801 | 10/1990 | Iglesia et al. | 518/715 |
| 5,156,884 | 10/1992 | Tanitsu et al. | 427/558 |
| 5,236,874 | 8/1993 | Pintchovski | 437/245 |
| 5,256,443 | 10/1993 | Tomita | 427/125 |
| 5,858,451 | 1/1999 | Boyle | 427/79 |
| 5,928,983 | 7/1999 | Culross | 502/170 |

*Primary Examiner*—Shrive Beck
*Assistant Examiner*—Michael Barr
*Attorney, Agent, or Firm*—Elmer A. Klavetter

[57] ABSTRACT

A method of preparing metal oxide thin films by a solution method. A β-metal β-diketonate or carboxylate compound, where the metal is selected from groups 8, 9, 10, 11, and 12 of the Periodic Table, is solubilized in a strong Lewis base to form a homogeneous solution. This precursor solution forms within minutes and can be deposited on a substrate in a single layer or a multiple layers to form a metal oxide thin film. The substrate with the deposited thin film is heated to change the film from an amorphous phase to a ceramic metal oxide and cooled.

16 Claims, No Drawings

METHOD OF PRODUCING SOLUTION-DERIVED METAL OXIDE THIN FILMS

This invention was made with Government support under Contract No. DEAC04-94AL85000 awarded by the Department of Energy. The Government has certain rights in the invention.

BACKGROUND OF THE INVENTION

The present invention relates generally to the preparation of metal oxide thin films and more particularly to the preparation of solution-derived metal oxide thin films from metal diketonate or carboxylate precursors.

Metal oxide thin films have applications ranging from catalysts to capacitors. For example, ruthenium oxide materials can be used in electrochemical capacitors and nickel-, cobalt- and rhodium-oxide thin films are useful in catalysis of hydrocarbon oxidation reactions.

Solution routes are widely used for the production of thin films through spin-casting or dip-coating methodologies. These methods are typically used due to the flexibility in the stoichiometry of precursor solutions, the ease of altering processing variables, cost effectiveness (inexpensive), and the reduction of the sintering temperatures.

Sol-gel methods are often used to produce thin films but sol-gel processing generally suffers from limitations due to the relative solubilities of the various metals salts and metal alkoxides. Therefore, the starting materials are often modified to permit adequate solubility, adding processing steps to the method. These methods generally require synthesis of novel starting materials, relatively long mixing times, and/or heating during preparation of the desired precursor solutions. Miller et al., in U.S. Pat. No. 5,116,643, issued on May 26, 1992, as well as in U.S. Pat. No. 4,946,710 issued on Aug. 7, 1990, and in U.S. Pat. No. 5,028,455 issued on Jul. 2, 1991, describe a sol-gel method for producing ferroelectric thin films using alcohol and acid solvents in proportions sufficient to ensure equal reaction rates. However, Miller et al. also require heating to drive off the solvent, the addition of further reagents to quench reactivity and the introduction of water to hydrolyze the produced precursors.

Hampden-Smith, in U.S. Pat. No. 5,308,601 issued on May 3, 1994, describes a metallo-organic decomposition method for making metal oxides at low temperatures. Again, because of the problems associated with achieving adequate solubility, the method of Hampden-Smith requires synthesis of the starting materials as well as acid modification of all precursors and the addition of water.

One standard method of producing metal oxide solutions has been to decompose or hydrolyze metal halide compounds to yield the metal oxide. For example, Zheng et al. (U.S. Pat. No. 5,851,506, issued on Dec. 22, 1998) and Jow et al. (U.S. Pat. No. 5,600,535, issued on Feb. 4, 1997) also discuss a method for making ruthenium oxide by hydrolyzing ruthenium compounds, and more particularly ruthenium halide compounds, in an aqueous solution at an elevated temperature with the addition of a hydroxide compound. Zheng et al. utilized this process to eliminate the need to form the precursor metal oxide solution by decomposing ruthenium chloride at elevated temperatures of 300–400° C. as was previously done in prior art.

Tomita (U.S. Pat. No. 5,256,443, issued on Oct. 26, 1993) discuss a method of preparing thin films from a sol solution containing a noble metal alkoxide in an organic solvent for use in sensor applications. Tomita starts with one or more metal alkoxides in an alcohol solvent with acetic acid as a catalyzing agent to form a solution that can be deposited as a thin film on a substrate.

Boyle et al. (U.S. Pat. No. 5,858,451, issued on Jan. 12, 1999) present a solution-route method for synthesizing ferroelectric material thin films of the general formula $(Pb,La)(Nb,Sn,Zr,Ti)O_3$ using multiple metal precursor solutions dissolved in amine and other solvents where the metal precursor compounds can be metal acetates or metal acetylacetonates.

Improvements to the preparation of metal-oxide thin film materials by these methods would be to reduce the preparation or synthesis time, to prepare the materials using commercially-available starting materials, to reduce the concentration of impurities in the final film, and to reduce the severity of the preparation conditions, particularly the severity of the heating conditions. Once the precursor solutions have been prepared, either thin films or powders can be prepared by standard methods.

SUMMARY

According to the present invention, a method is provided for making a metal-oxide precursor solution by solublizing a metal diketonate or carboxylate compound in a strong Lewis base to form a homogeneous metal-oxide precursor solution, with the precursor solution deposited on a substrate to form a thin film. The thin film is heated to between 450° C. and 700° C. to sinter the thin film into the metal oxide thin film. The metal used can be Fe, Co, Ni, Cu, Zn, Ru, Rh, Pd, Ag, Cd, Ir, Pt, or Hg. Multiple-layer thin films can be produced by sequential deposition of the precursor solution onto the substrate.

In the method of the present invention, the strong Lewis base is an amine solvent, preferably selected from the group consisting of pyridine, 1-methylimidizole, dimethylformamide, diethylamine. The strong Lewis base can be mixed with a carboxylate acid, such as acetic acid. Solvents, such as toluene, can be mixed with the strong Lewis base to improve wettability characteristics or modifiers, such as nitric acid and phosphoric acid, can be added to reduce the volatility of the precursor solution.

DETAILED DESCRIPTION OF THE INVENTION

According to the present invention, a preferred synthesis method to generate metal oxide thin films is provided. A metal compound, where the metal is selected from groups 8, 9, 10, 11, and 12 of the Periodic Table, is solubilized in a strong Lewis base, with optional heating of approximately 30° C. to 120° C. to aid in solubilization, to form a homogeneous solution. This precursor solution forms within minutes and is a precursor solution to the subsequent metal oxide thin films. This solution can be deposited on a substrate to form a metal oxide thin film. If desired, multiple thin-film layers can be deposited in sequential steps. The substrate with the deposited thin film is heated to change the film from an amorphous phase to a ceramic metal oxide and cooled.

According to the method of the present invention, the metal compound can be any metal β-diketonate or carboxylate derivative where the metal is a Group 8, 9, 10, 11 or 12 metal or more specifically, Fe, Co, Ni, Cu, Zn, Ru, Rh, Pd, Ag, Cd, Ir, Pt, and Hg. Importantly, these compounds are generally commercially available, including such compounds as $Ru((OC(CH_3))_2CH_2)_3$, $Ir((OC(CH_3))_2CH_2)_3$, $Cu(O_2CCH_3)_2$, $Ru((OC(CH_3))_2CH_2)_2$, $Fe(O_2CCH_3)_2$, and $Zn(O_2CCH_3)_2\cdot(H_2O)_2$. Gold and osmium diketonates or carboxylates were not found to be commercially available. The metal compounds are limited in the present invention to the metals in Groups 8, 9, 10, 11, and 12 as experimentation discovered that not all metals can be solubilized in the solvents of the present invention to rapidly form a homogenous solution. For example, a strontium β-diketonate compound was not dissolved, even with heating, in a pyridine solvent using the method of the present invention.

Solubilization in a strong Lewis base is an important part of the method of the present invention for the formation of homogeneous solutions. The precursor solutions are generated using a strong Lewis solvent, such as a basic amine solvent, or, optionally, a mixture of a strong Lewis basic amine solvent and a carboxylate acid. Examples of suitable Lewis basic amine solvents include pyridine, 1-methylimidizole, dimethylformamide, and diethylamine. An example of the carboxylic acid is acetic acid. Toluene, or other polar solvents, can be added to the above solutions to improve the wetting characteristics (i.e., allow the solution to more easily wet the substrate). Modifiers can be introduced to reduce the volatility of these precursors to develop thicker films, including nitric acid and phosphoric acid.

This solution can be deposited, such as by standard spin-cast or dip-cast deposition methods, on any silicon or metal-based, such as Au, Ti and Pt, substrate. Multi-layered films can be produced by sequential deposition of individual layers. Thin film layers can be deposited, in air, onto substrates, such as Pt-coated $SiO_2$/Si substrates, using a photoresist spinner, at approximately 2000–3000 rpm and preferentially at about 3000 rpm, for about 30 seconds. After each thin film layer deposition, the films are optionally heated, for example by placement on a hot plate, at approximately 100–300° C. for approximately 5 minutes. This heat treatment is optionally used to evaporate some of the organics from the deposited film and allow some pre-crystallization to occur.

This step can improve the quality of subsequently produced ceramic metal oxide.

The deposited film or films on the substrate is then heated to between 450 and 700° C. to sinter the deposited film into a ceramic metal oxide.

EXAMPLES

Solution preparation.

The precursor solutions are preferentially generated under dry (argon) conditions to better control the final film properties. The following compounds were used as received: $Ru((OC(CH_3))_2CH_2)_3$, $Ir((OC(CH_3))_2CH_2)_3$, $Cu(O_2CCH_3)_2$, $Rh(O_2CCH_3)_2$, $Fe(O_2CCH_3)_2$, and $Zn(O_2CCH_3)_2$.

Example 1

Preparation of ruthenium oxide thin films.

0.5 g of $Ru((OC(CH_3))_2CH_2)_3$, referred to as $Ru(acac)_3$ where the group $[(OC(CH_3))_2CH_2]$ is designated as acac, was dissolved in a vial in a pyridine:toluene (~4:1) mixture to generate a homogeneous precursor solution. This solution was used to generate a thin film. Films were deposited by spin-cast or dip-cast deposition on Pt and Ti metal surfaces. The solution was used to coat the surface and then slightly warmed at 100° C. to dry the solution. The solution and substrate were then heated in a furnace at approximately 450° C.–600° C. to crystallize the material. Because the $Ru(acac)_3$ is very volatile, only a very thin film results. Addition of $HNO_3$, $HO_2C(CH_3)$ or $H_3PO_4$ to the precursor solution yielded thicker films.

Example 2

Preparation of iridium oxide thin films.

0.5 g of $Ir(acac)_3$ was dissolved in pyridine/acetic acid (HOAc) (~4:1) with heating at approximately 40° C. to yield a clear solution. This solution was used to make films by spin-cast deposition with in one case (a) a 120° C. hot plate treatment and in another case (b) no heat. Both substrates with the thin films were placed in a furnace and heated up to 400–600° C. Very thin films of iridium oxide were formed.

Example 3

Preparation of copper oxide thin films.

A 0.4M solution of $Cu(OAc)_2$ (0.5 g) in pyridine/HOAc (~4:1) was prepared at a temperature of approximately 120° C., generating a homogenous precursor solution. Thin films were deposited and heat treated on a 300° C. hot plate and then heated to 650° C. to form the copper oxide thin film.

Example 4

Preparation of rhodium oxide thin films.

A 0.4M solution of $Rh(OAc)_2$ (0.5 g) in pyridine/HOAc (~4:1) was prepared at a temperature of approximately 120° C., generating a homogenous and clear precursor solution. Multiple layers were formed with each layer heat treated at 300° C. to pre-crystallize the film and then heated at 700° C. to form the ceramic rhodium oxide thin film. The individual film layers were less than approximately 500 Å.

Example 5

Preparation of iron oxide thin films.

A 0.4 M solution of $Fe(O_2CCH_3)_2$ (0.5 g) in pyridine (~4:1) was prepared, generating a homogeneous precursor solution and spin-cast deposited on a substrate as a thin film. The film was pre-crystallized at approximately 300° C. on a hot plate and subsequently heated to approximately 700° C. to form the iron oxide thin film.

Example 6

Preparation of zinc oxide thin films

A 0.4M solution of $Zn(O_2CCH_3)_2(H_2O)_2$ (0.5 g)in pyridine/HOAc (~6:1) was prepared, generating a homogeneous precursor solution and spin-cast deposited on a substrate as a thin film. The film was pre-crystallized at approximately 300° C. on a hot plate and subsequently heated to approximately 600° C. to form the iron oxide thin film.

Example 7

Multi-layered Thin Film Formation

Multi-layered films of the precursor solutions from Examples 1–6 can be spin-coat or dip-cast deposited, in air, onto a substrate. For spin-coat deposition, a photoresist spinner can be used at approximately 3000 rpm for about 30 sec for each layer. After each deposition of another film layer, the film is optionally baked on a hot plate (at approximately 100–300° C. for approximately 5 min) to pre-crystallize the thin film and allowed to cool to room temperature for about 5 min before introduction of the next layer. The pre-crystallization step allows production of higher quality thin films. The thin films are then heated to between 450° C. and 700° C. to sinter the films and form the ceramic metal oxide thin films

Example 8

Preparation of strontium-oxide thin films.

0.5 grams of $Sr(O_2CCH_3)_2$ was placed in a pyridine/toluene solvent and solubilization attempted at temperatures up to >120° C. Solubilization was not achieved and thin films could not be prepared.

Example 9

Preparation of an insulator/resistor/capacitor chip.

One important application of the method of the present invention is the preparation of an insulator/resistor/capacitor chip through a low temperature, single-fire process. For such a process, needed is a solution-route method for preparing the various electrical components. Using the method described in Example 5 to prepare an iron oxide thin film, an inductor was prepared comprising an iron oxide thin film dip-coated on one section of a platinized silica chip; a resistor was prepared on the same chip comprising a ruthenium oxide thin film dip-coated on a different section of the chip with the thin film, with the thin film preparation as described in Example 1. The capacitor was prepared by a thin film deposition of a ferroelectric thin film known in the art. All components were heated simultaneously at 650° C. to form the correct metal oxide phases, resulting in a more efficient process with relatively uniform processing conditions.

Although the invention has been described with respect to particularly preferred embodiments, modifications obvious to one of ordinary skill in the art are contemplated to be within the scope of the invention.

We claim:

1. A method for making a Ru-oxide film on a substrate, comprising:

solubilizing a metal compound in a Lewis base to form a homogeneous metal-oxide precursor solution, said metal compound selected from the group consisting of Ru diketonates and Ru carboxylates;

depositing the metal-oxide precursor solution as a film on a substrate; and sintering the film on the substrate at a temperature between 450° C. and 700° C. to make a Ru-oxide film.

2. The method of claim 1 wherein the Lewis base is an amine solvent.

3. The method of claim 1 wherein the Lewis base is selected from the group consisting of pyridine, 1-methylimidizole, dimethylformamide, and diethylamine.

4. The method of claim 1 wherein the metal diketonate is a metal acetylacetate.

5. The method of claim 1 wherein the step of depositing the precursor solution as a film on a substrate is by spin-cast or dip-cast deposition.

6. The method of claim 5 wherein the substrate is selected from a group consisting of silicon, Au, Ti, and Pt.

7. The method of claim 5, wherein the step of depositing the precursor solution as a film on a substrate comprises spin-cast deposition of the film in successive layers, one on top of the other, each layer being heat treated under ambient atmosphere at about 300° C. for about 5 minutes and allowed to cool before deposition of the next layer.

8. The method of claim 1 wherein the Lewis base is mixed with a carboxylate acid.

9. The method of claim 8 wherein the carboxylate acid is acetic acid.

10. The method of claim 1 wherein the Lewis base is mixed with a solvent used to improve wettability characteristics.

11. The method of claim 10 wherein the solvent is toluene.

12. The method of claim 1 wherein the Lewis base is mixed with at least one modifier to reduce the volatility of the precursor solution.

13. The method of claim 12 wherein the at least one modifier is selected from the group consisting of nitric acid and phosphoric acid.

14. The method of claim 1 wherein the solubilizing of the metal compound occurs at a temperature from approximately 30° C. to 120° C.

15. The method of claim 5, further comprising the step of heating the film at a temperature between approximately 100° C. and 300° C.

16. The method of claim 1 wherein the metal compound is $Ru((OC(CH_3))_2CH_2)_3$ and the Lewis base is pyridine, said pyridine mixed with toluene.

* * * * *